US006672190B2

(12) United States Patent
Taylor

(10) Patent No.: US 6,672,190 B2
(45) **Date of Patent: *Jan. 6, 2004**

(54) PRECISION MITER GAUGE

(75) Inventor: Christopher L. Taylor, Dallas, TX (US)

(73) Assignee: Taylor Design Group, Inc., Carrollton, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/563,734

(22) Filed: May 3, 2000

(65) Prior Publication Data

US 2003/0015078 A1 Jan. 23, 2003

(51) Int. Cl.[7] ..... B26D 7/06

(52) U.S. Cl. ..... 83/435.14; 83/435.13; 83/522.25; 83/437.2; 83/438; 83/581; 33/469; 33/471

(58) Field of Search ..... 83/437.2, 581, 83/438, 477.2, 421, 435.12, 522.18, 435.13, 435.14, 522.17, 522.19; 33/468, 469, 470, 471, 640, 534, 1 R, 1 N, 465

(56) References Cited

U.S. PATENT DOCUMENTS

| | | | | | |
|---|---|---|---|---|---|
| 20,356 | A | * | 5/1858 | Lyman | 33/468 |
| 483,499 | A | * | 9/1892 | McChesney | 33/469 |
| 842,585 | A | * | 1/1907 | Ross | 33/469 |
| 1,894,010 | A | * | 1/1933 | Tautz | 269/55 |
| 1,985,614 | A | * | 12/1934 | Merrigan | 33/500 |
| 2,051,741 | A | * | 8/1936 | Parker, Jr. | 33/471 |
| 2,237,556 | A | * | 4/1941 | Hedgpeth | 33/430 |
| 2,423,164 | A | * | 7/1947 | Williams | 33/534 |
| 2,423,786 | A | * | 7/1947 | Morris | 33/468 |
| 2,443,364 | A | * | 6/1948 | Vancura | 33/471 |
| 2,594,574 | A | * | 4/1952 | Mardsen | 33/471 |
| 2,651,844 | A | * | 9/1953 | Smith | 33/471 |
| 2,759,503 | A | * | 8/1956 | Goldschmidt | 269/165 |
| 2,894,326 | A | * | 7/1959 | Mardsen | 33/1 N |
| 2,904,885 | A | * | 9/1959 | Wood, Sr. | 33/1 N |
| 4,741,387 | A | * | 5/1988 | Strong | 83/421 |
| 5,038,486 | A | | 8/1991 | Ducate, Sr. | |
| 5,491,906 | A | * | 2/1996 | Reilly | 33/430 |
| 5,845,410 | A | * | 12/1998 | Boker | 33/471 |
| 6,256,900 | B1 | * | 7/2001 | Myers | 33/469 |

OTHER PUBLICATIONS

Taylor Design Group, Inc., *Owner's Manual for Incra Miter Sled*, 1999.

The Osborne Manufacturing Company, *Instruction Manual for The Osborne Miter Guide*.

* cited by examiner

*Primary Examiner*—Boyer Ashley
*Assistant Examiner*—Thomas J Druan, Jr.
(74) *Attorney, Agent, or Firm*—Thompson & Knight LLP; Robert C. Hilton; Richard L. Wynne, Jr.

(57) ABSTRACT

The present invention provides a precision miter gauge for orienting and positioning a workpiece relative to a cutting tool. The miter gauge reduces positioning errors and improves repeatability. The miter gauge includes a base and a body pivotably connected to the base. A positioning edge of the body contains a plurality of teeth between which a positioning member connected to the base is inserted and locked in place. In this manner, relative movement of the positioning body relative to the base is inhibited.

13 Claims, 7 Drawing Sheets

PRECISION MITER GAUGE

FIELD OF THE INVENTION

The present invention relates generally to woodworking equipment, and in particular, to an apparatus for precisely orienting a workpiece in a predetermined angular relationship to a cutting tool.

BACKGROUND OF THE INVENTION

Operations associated with the cutting of wood or other materials with a power tool require the workpiece to be positioned accurately relative to the tool in order to achieve the desired results. In certain applications, the positioning of the workpiece is accomplished through the use of a "fence" which is positioned relative to the tool. Often, such as in table saw applications, the workpiece must be positioned such that the fence is at an angle relative to the saw blade. The typical method to achieve such angular positioning is to couple the fence to a miter gauge slidably disposed on the working surface of the table saw.

The use of a miter gauge in combination with a table saw is well-known in the art. Indeed, most table saws are sold with a miter gauge as a standard piece of equipment associated with the saw. In most cases, even when performing cuts in which the fence is perpendicular to the saw blade, the fence against which the workpiece is positioned is secured to a miter gauge set at a zero-degree angle.

Traditional miter gauges suffer from a wide variety of shortcomings. Notably, they typically lack the repeatability necessary to replicate cuts at specific angles without undue experimentation. This is caused, in large part, because existing miter gauges typically provide pre-defined stops at certain specific angles, typically 0, 15, 22½, 30, and 45 degrees. At any angle other than these limited positions, an accurate angular setting must be performed by trial-and-error.

But even when the woodworker intends to make a cut using one of the pre-defined stops on an existing miter gauge, the accuracy or repeatability of the cut is not absolute. On a typical existing miter gauge, a shot pin slidably connected to a fixed base is inserted into pre-drilled holes on the angularly adjustable miter head corresponding to the various pre-defined angular settings. The shot-pin mechanism requires that the hole have a diameter that is larger than the diameter of the shot pin. That difference in diameter introduces some angular error into the miter gauge. Further error arises from the mechanical sleeve in which the shot pin is secured to the fixed base of the miter gauge. Because the shot pin must be free to slide within that sleeve, lateral movement of the pin within the sleeve will lead to an angular position error when the pin is inserted into the holes in the miter head.

A further shortcoming of existing miter gauges is that they cannot provide the rigidity necessary for many woodworking operations. The lack of rigidity arises because, when an angle, other than one for which the shot-pin mechanism is provided, must be used, the pivoting miter head is secured to the fixed base through a bearing load applied through a single bolt. Typically, that bolt is inserted through a curved slot in the pivotable miter head and threaded into the fixed base. When the miter head is set at the desired angle, the bolt is tightened placing a bearing load between the miter head and a shoulder of the bolt and between the miter head and the base, thereby inhibiting angular movement of the miter head. Because the miter head is held in position only by the bearing load applied through the single bolt, the amount of torque applied to the miter head during certain woodworking operations, especially those involving large workpieces, may overcome the bearing load, causing an undesired rotation of the miter head.

One example of an existing table-saw miter gauge is described in U.S. Pat. No. 5,038,486 issued to Ducate, Sr. The '486 patent describes a typical miter gauge using a shot-pin mechanism for angularly positioning the miter gauge at certain pre-defined angles. For any angle other than the angles having a hole in the miter head for receiving the shot pin, the angular position is determined using a scale imprinted on the miter head. Assuming that such a scale was accurate, existing miter gauges such as in the '486 patent do not provide any method other than simple visual estimation for setting the miter-head angle at any angle that does not have a corresponding mark on the scale.

Therefore, what is needed is a miter gauge capable of performing precision miter cuts without requiring trial-and-error setups. The miter gauge should be capable of precisely orienting a workpiece with respect to the blade of a cutting tool with a resolution of finer than one-half degree. The ability to perform repeated cuts of precise angles should also be enabled by the miter gauge intended as a solution to prior art limitations.

SUMMARY OF THE INVENTION

The present invention seeks to resolve the above and other problems with the prior art. More particularly, the invention is an advancement in the art by providing a precision miter gauge achieving the objects listed below:

It is an object of the present invention to provide a precision miter gauge capable of making precision miter cuts when used with a cutting tool such as a table saw.

It is a further object of the present invention to provide a miter gauge capable of securely positioning a workpiece relative to a cutting tool.

It is a further object of the present invention to provide a miter gauge capable of delivering precision, repeatable miter cut accuracy without trial-and-error setups.

It is still a further object of the present invention to provide a miter gauge with positive angle stops capable of providing angular measurement accuracy and absolute miter gauge engagement to one-half degree of precision.

It is a further object of the present invention to provide a miter gauge allowing continuous angular adjustment capable of establishing miter cuts with finer than one-half degree of precision.

It is a further object of the present invention to provide a miter gauge capable of being employed with a slot disposed on either side of a cutting tool.

To accomplish the foregoing objects, the present invention provides a miter gauge for orienting a workpiece with respect to a cutting tool including a base, a pivotable body pivotably connected to said base, the pivotable body having a positioning edge, the positioning edge containing a plurality of teeth defining a plurality of notches between the teeth, a positioning member connected to said base, the positioning member including a teeth interface element configured to be inserted into at least one of the notches, and means for inhibiting movement of the pivotable body relative to the base.

BRIEF DESCRIPTION OF THE DRAWINGS

Other objects, advantages, features and characteristics of the present invention, as well as methods, operation and functions of related elements of structure, and the combination of parts and economies of manufacture, will become apparent upon consideration of the following description and claims with reference to the accompanying drawings, all of which form a part of this specification, wherein like reference numerals designate corresponding parts in the various figures.

DETAILED DESCRIPTION OF THE INVENTION

Figure 1:
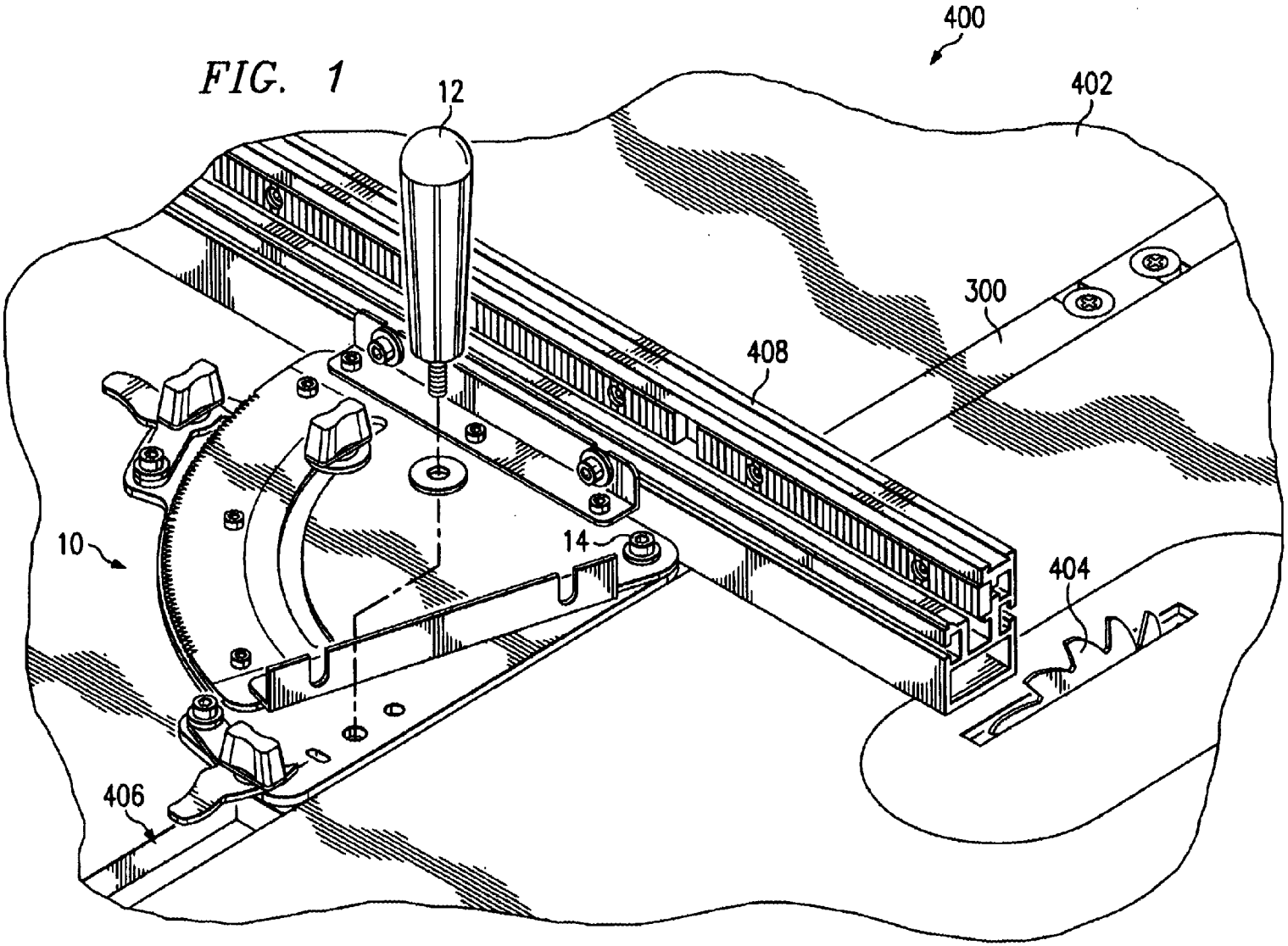
FIG. 1 illustrates an operational implementation of a preferred embodiment of the current invention on a conventional table saw.

A typical installation of miter gauge 10 on a conventional table saw 400 is shown in FIG. 1. Table saw 400 includes a substantially horizontal working surface 402. A portion of saw blade 404 protrudes through working surface 402. Longitudinal slot 406 is disposed within working surface 402 and is substantially parallel to the cutting axis of saw blade 404. In FIG. 1, slot 406 is shown as being located to the left of saw blade 404. Those skilled in the art understand that conventional table saws include two longitudinal slots within the working surface, one to the left of the saw blade and one to the right of the saw blade.

In the installation of FIG. 1, fence 408 is removably attached to miter gauge 10. Fence 408 is used for positioning a workpiece (not shown) relative to the saw blade 404, by maintaining an edge of the workpiece in abutting relationship with a face of fence 408. To permit sliding movement of miter gauge 10 along the axis of saw blade 404, miter gauge 10 is connected to a guide 300. In the preferred installation shown in FIG. 1, miter gauge 10 is connected to guide 300 using threaded miter push knob 12 and a shoulder bolt 14. Guide 300 is slidably disposed within slot 406 to enable the workpiece, when positioned against fence 408, to be moved relative to saw blade 404 along the cutting axis of the blade. Those skilled in the art understand the operation of guide 300 when installed on table saw 400. Thus, the details of the guide's operations need not be included.

As will be appreciated by those of ordinary skill in the art, as described in greater detail below, a portion of miter gauge 10 is pivotable about shoulder bolt 14 to vary the angle of fence 408 relative to the cutting axis of saw blade 404.

Figure 2:
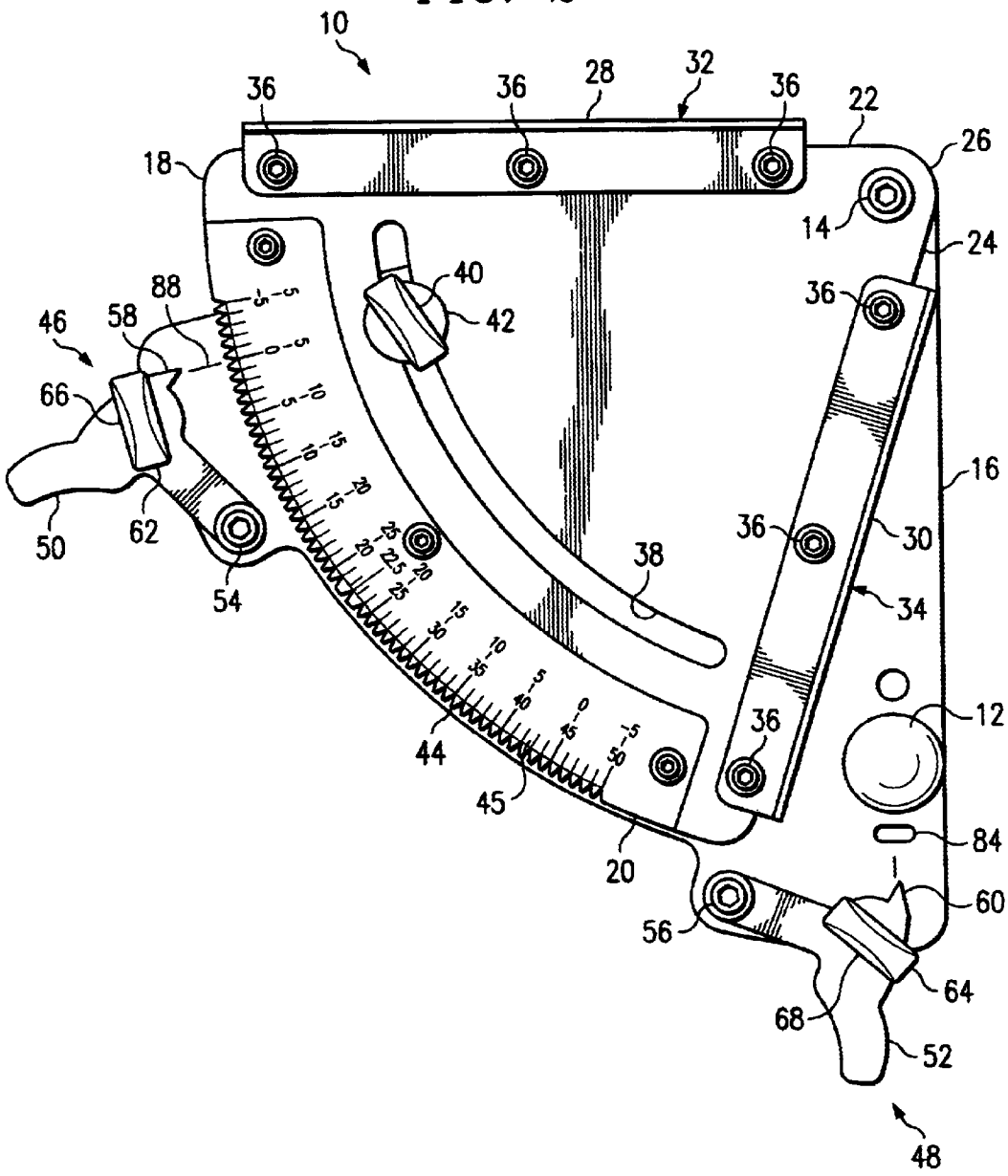
FIG. 2 depicts a top view of a preferred embodiment of the miter gauge of the current invention.

FIG. 2 depicts a preferred embodiment of the miter gauge 10. A substantially wedge-shaped base plate 16 is connected to a substantially wedge-shaped top plate 18 using shoulder bolt 14. When so connected, top plate 18 is pivotable about shoulder bolt 14 relative to base plate 16. While a variety of materials could be used, base plate 16 and top plate 18 are preferably steel because of the strength and rigidity necessary for many woodworking operations.

Top plate 18 includes a first engagement edge 22 and a second engagement edge 24, the intersection of which is at corner 26 of top plate 18. Opposite corner 26 and connecting first and second engagement edges 22 and 24 is positioning edge 20 of top plate 18. Preferably, positioning edge 20 is configured to form an arc. First and second fence attachment flanges 28 and 30 are mounted to top plate 18. First flange 28 includes a face 32 that is substantially parallel to first engagement edge 22. Similarly, second flange 30 includes a face 34 that is substantially parallel to second engagement edge 24. Preferably, first and second flanges 28 and 30 are connected to top plate 18 using a plurality of screws 36, but those skilled in the art will appreciate that any method of attachment, including riveting, welding, and the like, could be used. Also, the flanges could be integrally formed as part of top plate 18. As will be described in greater detail below, first and second flanges 28 and 30 are used to attach a woodworking fence to miter gauge 10.

Figure 3:
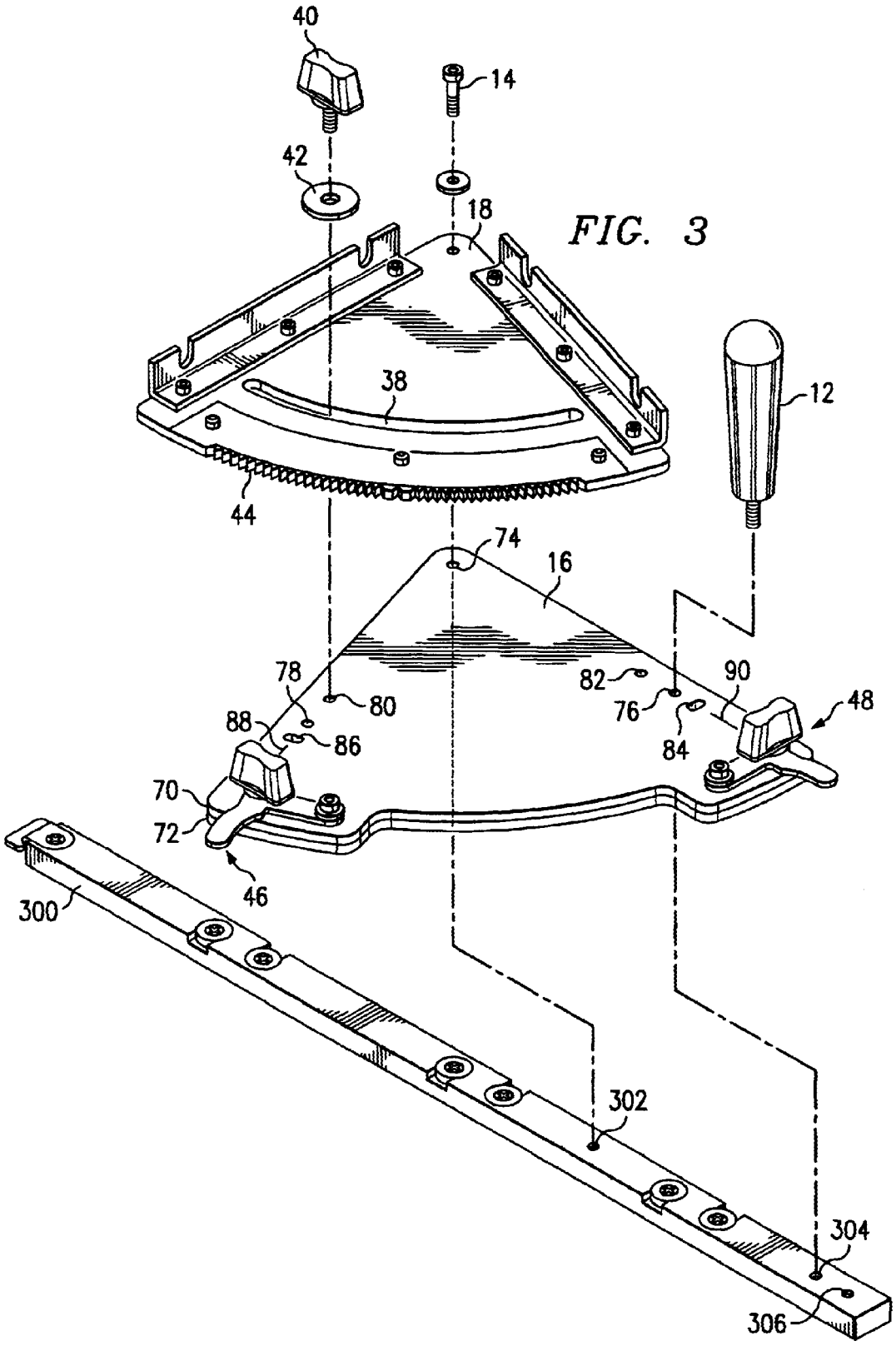
FIG. 3 illustrates a partially exploded view of a preferred embodiment of the miter gauge of the current invention.

As shown in FIG. 2 and in the partially exploded view in FIG. 3, top plate 18 includes arcuate slot 38. The threaded shaft of thumbscrew 40 is disposed through a flat washer 42 and arcuate slot 38 and threaded into a threaded hole 80 in base plate 16 such that when thumbscrew 40 is tightened, top plate 18 is clamped between flat washer 42 and base plate 16, thereby inhibiting movement of top plate 18 relative to base plate 16. When thumbscrew 40 is loosened, however, top plate 18 may be pivoted in either direction about shoulder bolt 14 relative to base plate 16 to the position at which thumbscrew 40 impacts either extent of arcuate slot 38.

Positioning edge 20 includes a plurality of teeth 44 disposed thereon. Each tooth corresponds to an angular position of top plate 18 relative to bottom plate 16. Preferably, the teeth are spaced according to one degree increments, although a special tooth spacing is provided at a predefined position according to an angular position of 22½ degrees. A template 45, which is preferably an angular scale, may be disposed on top plate 18 for use in angularly positioning top plate 18 relative to base plate 16 by providing marks at predetermined intervals along template 45 according to the angular positions of teeth 44.

Referring to FIG. 2, attached to bottom plate 16 are first and second actuators 46 and 48. First actuator 46 includes a first hammer 50 pivotably attached to bottom plate 16 by shoulder bolt 54. First hammer 50 includes an actuator tooth 58 configured to engage teeth 44 disposed on positioning edge 20. Those of ordinary skill in the art will appreciate that top plate 18 may be pivoted relative to bottom plate 16 to a position at which tooth 58 engages the notch formed between two adjacent teeth 44 according to the desired angular position of top plate 18. With tooth 58 so engaged, first hammer 50 is locked in place by first actuator thumbscrew 62, the shaft of which is disposed through a slot 66 in hammer 50 and threaded into a threaded hole in base plate 16. In this incremental angular positioning mode as described above, first actuator 46, in addition to providing precision positioning, serves to inhibit any movement of top plate 18 relative to base plate 16. Actuator tooth 58 is preferably configured to match the shape of the notch formed between any two adjacent teeth 44 of top plate 18. Thus, when first hammer 50 is locked in place using first actuator thumbscrew 62, actuator tooth 58 inhibits rotation of top plate 18. And because fence 408 (see FIG. 1) is connected to top plate 18, angular movement of fence 408 is similarly inhibited by locking actuator tooth 58 in place between adjacent teeth 44.

While the preferred embodiment of first actuator 46 has been described above, miter gauge 10 preferably also includes second actuator 48. In the preferred embodiment of miter gauge 10, only one of the actuators is used at a time. The determination of which actuator is used is dependent on whether miter gauge 10 is configured for use on the left or right slot associated with a woodworking tool. Those of ordinary skill in the art will readily understand that the operation of second actuator 48 is identical to that of first actuator 46. Second actuator 48 includes second hammer 52, which further includes actuator tooth 60. Second hammer 52 is pivotable about shoulder bolt 56 and includes slot 68 disposed therein. Second hammer 52 may be locked in place using second actuator thumbscrew 64 that is threaded into a hole in base plate 16.

Those skilled in the art will understand that a typical woodworking table saw includes two longitudinal slots disposed in the working surface of the table, which slots are substantially parallel to the cutting axis of the saw blade with one slot to the left and one slot to the right of the saw blade. For most woodworking operations, miter gauge 10 will be configured such that, when attached to guide 300, guide 300 will be disposed in the slot to the left of the blade, as depicted in FIG. 1. For clarity, the configuration of miter gauge 10 for use in connection with the left slot of the woodworking tool is referred to herein as the "left configuration." In the left configuration, fence 408 (see FIG. 1) is connected to first flange 28, and first actuator 46 is used to engage the teeth 44 of positioning edge 20 (see FIG. 2). Some applications, however, will require miter gauge 10 to be used with the slot to the right of the saw blade. In those applications, miter gauge 10 will be configured in the "right-reversed configuration" with fence 408 connected to second flange 30 and second actuator 48 engaging the teeth 44 of positioning edge 20. The reversible nature of miter gauge 10 is discussed in greater detail below.

The preferred configuration of base plate 16 is depicted in the partially exploded view in FIG. 3. Preferably, base plate 16 includes a steel main plate 70 attached to plastic sliding plate 72. When miter gauge 10 is used for woodworking operations such as in the table saw application of FIG. 1, those of ordinary skill in the art will appreciate that use of plastic sliding plate 72 on the lower surface of base plate 16 provides a sliding interface between working surface 402 and miter gauge 10 having less friction than a metal-to-metal interface would provide, thereby improving the operability of miter gauge 10.

Referring again to FIG. 3, base plate 16 further includes a series of apertures disposed therein, each of which performs a specific function. Pivot hole 74 is included in base plate 16 to allow base plate 16 to be pivotably coupled to guide 300, and for top plate 18 to be pivotably coupled to base plate 16 using shoulder bolt 14. In the preferred embodiment, shoulder bolt 14 passes through both top plate 18 and pivot hole 74 of base plate 16 and threaded into a first threaded hole 302 disposed in the upper surface of guide 300.

As shown in FIG. 3, base plate 16 preferably includes two series of apertures, similar to each other. First push knob attachment hole 76 is disposed in base plate 16 to permit installation of push knob 12 on miter gauge 10 when in the left configuration. A threaded end of push knob 12 passes through hole 76 and is received by a second threaded hole 304 in the upper surface of guide 300 to further connect miter gauge 10 to guide 300. For operation of miter gauge 10 in the left configuration, base plate 16 includes first threaded socket 80 for receiving thumbscrew 40.

Base plate 16 preferably includes a first slot 84. As an alternative to being disposed through hole 76, the threaded end of push knob 12 may be disposed through first slot 84 and threaded into a third threaded hole 306 in the upper surface of guide 300. As depicted in FIG. 2, teeth 44 of positioning edge 20 are preferably spaced to provide precision angular positioning of the miter gauge 10 at whole number angular increments. Some applications, however, may require precision positioning according to half-degree increments. With push knob 12 disposed through first slot 84, base plate 16, and correspondingly miter gauge 10, are pivotable about shoulder bolt 14 relative to guide 300 to the extent permitted by slot 84. Preferably, first slot 84 is configured so that when the threaded shaft of push knob 12 is abutted against one extent of first slot 84, the angular position of miter gauge 10 relative to guide 300 is −½ degree, and when abutted against the other extent of first slot 84, the angular position of miter gauge 10 relative to guide 300 is +½ degree, as compared to the angular position between miter gauge 10 relative to guide 300 when push knob 12 is disposed through first push knob attachment hole 76.

Thus, those skilled in the art will understand that precise ½-degree angular settings can be achieved by engaging actuator 46 with teeth 44 at the whole-number angular position adjacent to the desired setting and pivoting base plate 16 about shoulder bolt 14 to the position where the threaded shaft of push knob 12 is abutted against an extent of first slot 84. For example, if an angular setting of 29½ degrees is desired, top plate 18 is positioned such that actuator tooth 58 is positioned in the notch formed between two adjacent teeth 44, which notch corresponds to 29 or 30 degrees. With actuator 46 tightened when actuator tooth 58 is so positioned, base plate 16 is then pivoted until the threaded shaft is abutted against the respective extent of first slot 84 corresponding to +½ degree or −½ degree as appropriate.

Of course, some woodworking operations require a miter gauge to be set at angles other than those corresponding to whole or half degrees. Accordingly, the current invention provides means for precisely positioning the miter gauge 10 at any angle within the range of motion of the miter gauge. To provide this continuous indexing, base plate 16 preferably includes first indexing marker 88 extending radially in a direction from pivot hole 74 such that a portion of first indexing marker 88 is visible when top plate 18 is connected to base plate 16 as shown in FIG. 2.

Figure 4:
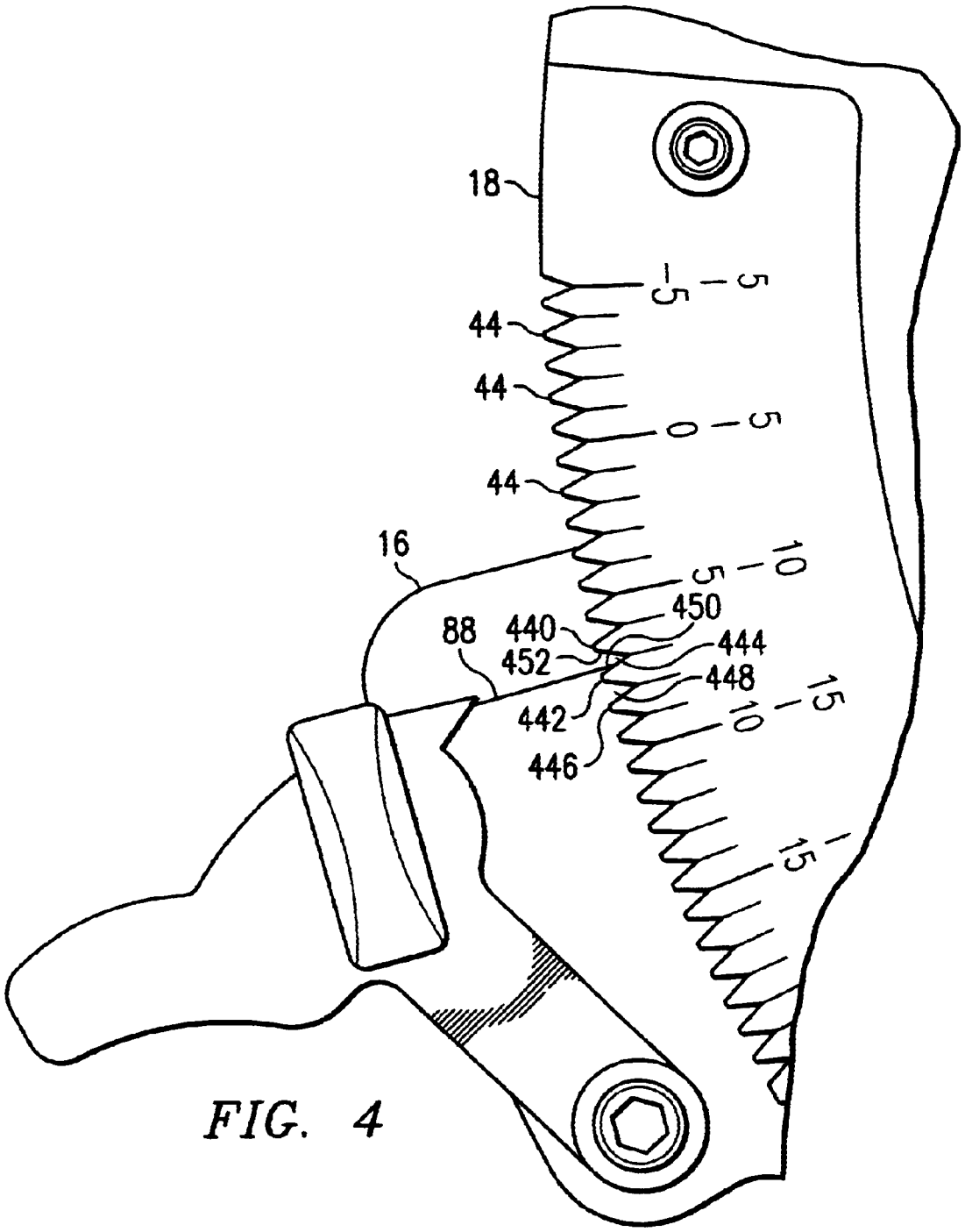
FIG. 4 illustrates the continuous adjustment feature employed by the present invention.

FIG. 4 demonstrates the operation of the continuous indexing feature of the present invention. When top plate 18 is pivoted to an angular position not corresponding precisely to a notch between any adjacent teeth of the teeth 44, the intersection of first indexing marker 88 and the edges of teeth 44 creates a vernier scale to accurately position top plate 18 angularly relative to base plate 16. In the example shown in FIG. 4, edges 452 and 450 of adjacent teeth 440 and 442 define notch 444 corresponding to an angular position of 7 degrees. In the preferred embodiment shown with one-degree tooth spacing, adjacent teeth 442 and 446 define notch 448 corresponding to an angular position of 8 degrees. The peak of tooth 442 corresponds to an angular position of 7.5 degrees. Thus, in the FIG. 4 example, if the woodworker wanted to adjust the top plate 18 (and consequently the fence 408 in FIG. 1) to an angle of 7.3 degrees, the woodworker would loosen thumbscrew 40 (see FIG. 2) and pivot top plate 18 to the position where first indexing marker 88 intersects edge 450 of tooth 442 at a point sixty percent of the distance from the intersection of edges 450 and 452 to the peak of tooth 442. When the first indexing member 88 is aligned at the proper angle on top plate 18, first thumbscrew 40 is tightened, clamping top plate 18 between washer 42 and base plate 16, inhibiting relative movement between top plate 18 and base plate 16.

As mentioned above, some woodworking operation require a miter gauge to be used with the slot in the working surface of a table saw that is located to the right of the saw blade. The preferred embodiment of miter gauge 10 is configured to enable it to be used with either the left or right table saw slot. Referring again to FIG. 3, base plate 16 preferably includes two sets of elements, namely apertures, markers, and actuators. When miter gauge 10 is in the left configuration for use with the left slot of a table saw, the first set of these elements are used, as described above. However, for use with the right slot, miter gauge 10 is reconfigured to the right-reversed configuration.

Figure 5:
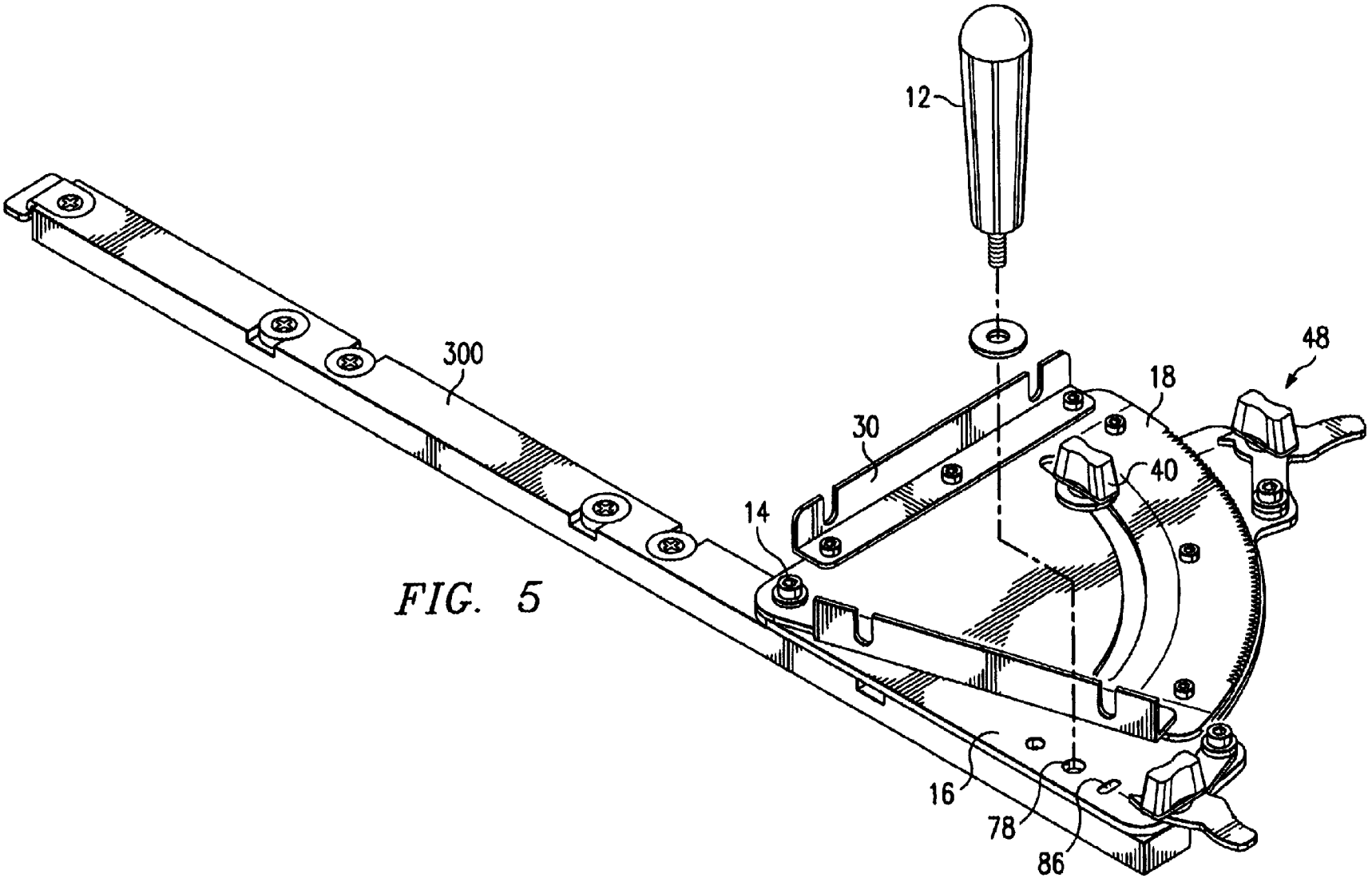
FIG. 5 illustrates the miter gauge of the present invention in the reversed configuration for use in the right miter slot of a cutting tool.

In the right-reversed configuration shown in FIG. 5, miter gauge 10 is pivotably connected to guide 300 using shoulder bolt 14. In addition, the threaded end of push knob 12 passes through either second push knob attachment hole 78 or second slot 86 and is threaded into the corresponding threaded hole in the upper surface of guide 300 as described above for the left configuration. Second slot 86 is identical in size to first slot 84, and thus, the half-degree adjustment described above in connection with first slot 84 is available in the right-reversed configuration using second slot 86. Thumbscrew 40 is threaded into second threaded socket 82. In the right-reversed configuration, second actuator 48 is employed to accurately position miter gauge 10 by engaging teeth 44 of top plate 18. Further, when the continuous indexing feature of miter gauge 10 is used in the right-reversed configuration, the woodworker uses the intersection of second indexing marker 90 and teeth 44 to accurately position the miter gauge.

Figure 6:
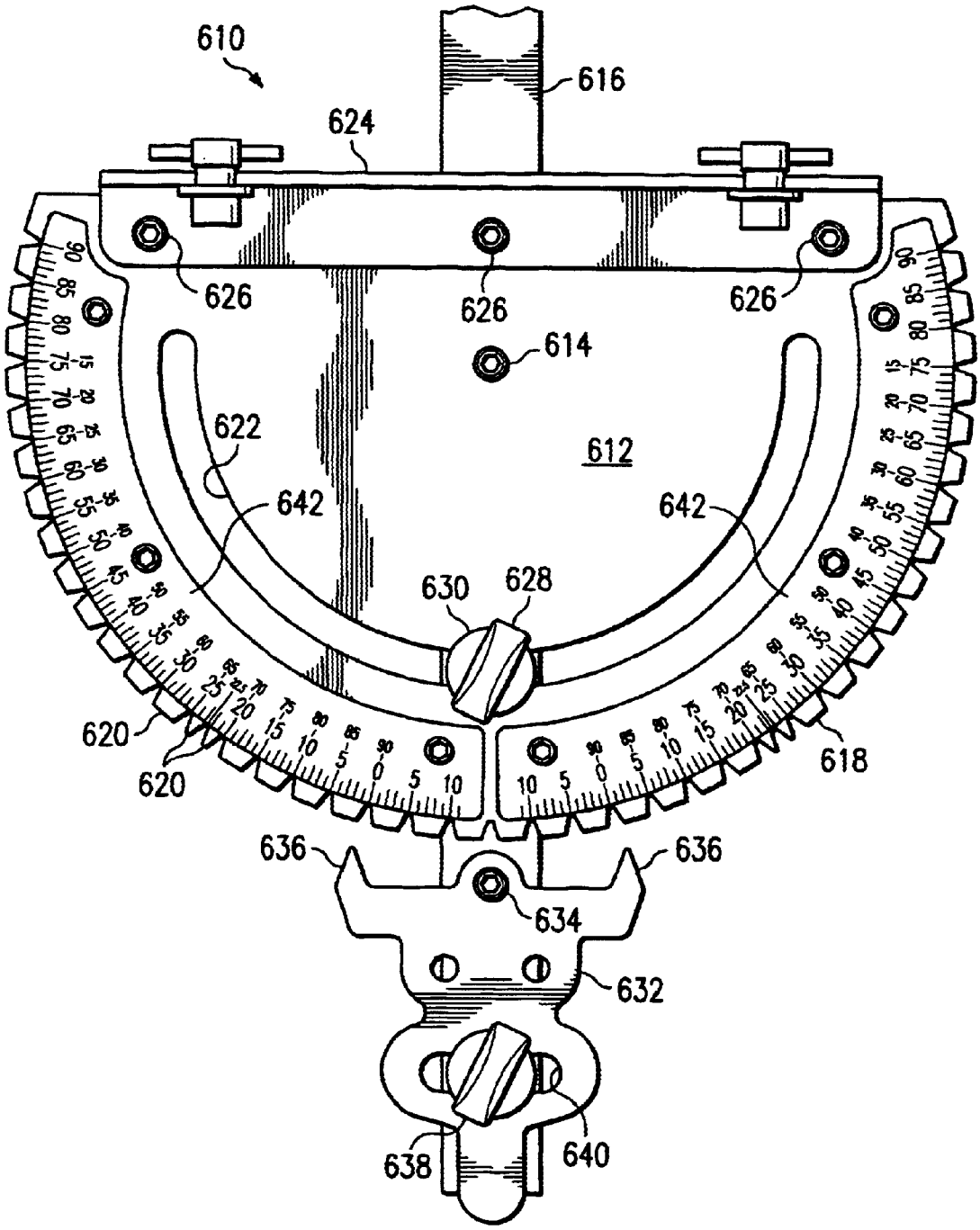
FIG. 6 illustrates an alternative embodiment of the miter gauge of the current invention.

In certain alternative embodiments such as the configuration shown in FIG. 6, the need for a reversible gauge is eliminated. In FIG. 6, miter gauge 610 includes a positioning plate 612 pivotably connected to a guide 616 using shoulder bolt 614. Positioning plate 612 includes a positioning edge 618 having a plurality of teeth 620 disposed thereon. Further, positioning plate 612 includes an arcuate slot 622.

Miter gauge 610 includes a flange 624 connected to positioning plate 612. Preferably, flange 624 is connected to positioning plate 612 using a plurality of bolts 626, but those skilled in the art will understand that any method of attachment, including riveting, welding, and the like, could be used. Also, flange 624 could be integrally formed as part of positioning plate 612. Flange 624 is used to attach a fence to miter gauge 610, as shown in FIG. 1 for the preferred embodiment of the miter gauge invention.

Similar to the preferred embodiment shown in FIGS. 2 and 3, in the alternative embodiment of FIG. 6, the threaded shaft of thumbscrew 628 is disposed through a flat washer 630 and arcuate slot 622. In this alternative embodiment, the threaded shaft of thumbscrew 628 is threaded into a threaded hole in guide 616.

Angular positioning of positioning plate 612 is accomplished through rotation of the positioning plate 612 about shoulder bolt 614. Unlike in the preferred embodiment described above, in this alternative embodiment, there is no base plate. Thus, positioning plate 612 is pivotably connected directly to the guide 616, which serves as the base of rotation for positioning plate 612. In operation, after positioning plate 612 has been pivoted to the desired angular position, thumbscrew 628 is tightened, clamping positioning plate 612 between washer 630 and guide 616, thereby inhibiting rotation of positioning plate 612.

Similar to the preferred embodiment, however, in the alternative embodiment shown in FIG. 6, miter gauge 610 includes an actuator 632 connected to guide 616 using shoulder bolt 634. Actuator 632 preferably includes two actuator teeth 636 to engage teeth 620 disposed on positioning edge 618. In operation, when positioning plate 612 is rotated to the desired angular position, actuator 632 is rotated either clockwise or counter-clockwise so that one of the actuator teeth 636 moves into the notch formed by two adjacent teeth 620 on positioning edge 618, which notch corresponds to the desired angular position. Those skilled in the art will readily appreciate that actuator 632 could be configured to have only one actuator tooth 636.

After the actuator 632 has been pivoted to insert one of actuator teeth 636 into the notch formed between two adjacent teeth 620 on positioning edge 618, actuator 632 is locked into place using actuator thumbscrew 638. A threaded shaft of actuator thumbscrew 638 is disposed through a slot 640 in actuator 632 and threaded into a threaded hole in guide 616. When actuator thumbscrew 638 is tightened, actuator 632 is clamped between guide 616 and the head of actuator thumbscrew 638 inhibiting movement of actuator 632 relative to guide 616.

A template 642, which is preferably an angular scale, may be disposed on positioning plate 612 for use in angularly positioning plate 612 relative to guide 616 by providing marks at predetermined intervals along template 642. Those skilled in the art will understand that in some situations, the operator will need to angularly configure the miter gauge 610 at angles that do not correspond to the angles associated with the teeth 620 on positioning edge 618. Thus, the scale of template 642 may be finer than that corresponding to the positions formed by teeth 620 on positioning edge 18. In those situations, the operator may use the tip of one of actuator teeth 636 as a pointer to the angles depicted on template 642 to set the proper angular position of positioning plate 612. When the proper position is so set, positioning plate 612 is locked in position by tightening thumbscrew 628.

Because of operational constraints of the typical woodworking table saw, it is impractical to space teeth 620 to correspond to one-degree angles, as in the preferred embodiment shown in FIG. 2. In the configuration of FIG. 6, the teeth 620 are defined to provide notches for precise and repeatable positioning at five-degree increments, with additional notches corresponding to ±22½ degrees. However, a second alternative embodiment shown in FIG. 7 provides for precise and repeatable positioning at much finer angles.

Figure 7:
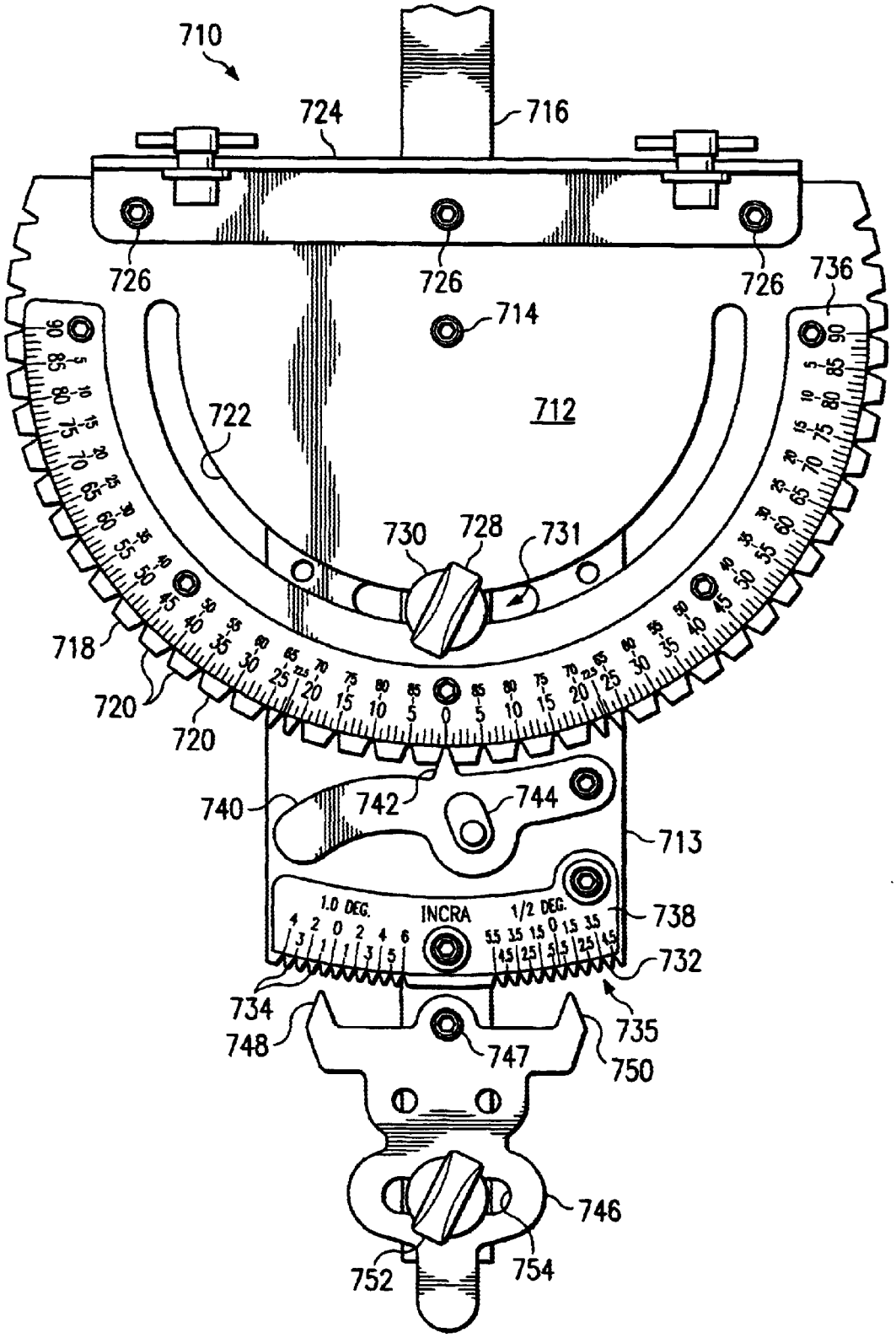
FIG. 7 illustrates another alternative embodiment of the miter gauge of the current invention.

In the alternative embodiment of FIG. 7, miter gauge 710 includes a positioning plate 712 disposed on a base plate 713. Positioning plate 712 is pivotable relative to base plate 713 and guide 716 about shoulder bolt 714, which is disposed through positioning plate 712 and base plate 713 and threaded into a threaded hole in guide 716. Similarly, base plate 713 is independently pivotable about shoulder bolt 714 relative to guide 716.

Similar to the alternative embodiment described in connection with FIG. 6, in the miter gauge 710 in FIG. 7, positioning plate 712 includes a positioning edge 718 having a plurality of teeth 720 disposed thereon. Positioning plate 712 also includes an arcuate slot 722. Attached to positioning plate 712 is flange 724 for connecting miter gauge 710 to a fence for woodworking and other materials fabrication operations. As in the previously described embodiments, flange 724 may be attached to positioning plate 712 using any standard attachment methods, but is preferably attached using a plurality of bolts 726.

The threaded shaft of thumbscrew 728 is disposed through washer 730, through arcuate slot 722, through aperture 731 in base plate 713, and is threaded into a threaded hole in guide 716. When thumbscrew 730 is tightened, relative movement of both positioning plate 712 and base plate 713 with respect to guide 716 is inhibited because both plates are clamped between washer 730 and guide 716.

In the alternative embodiment shown in FIG. 7, base plate 713 also includes a positioning edge 735 having a plurality of teeth 732 and 734 disposed thereon. Positioning plate 712 preferably includes a first template 736 disposed thereon, and base plate 713 preferably includes a second template 738 disposed thereon. Both templates are preferably angular scales having marks according to the angular positions of the notches formed by the teeth on the respective positioning edges of each plate. In the manner described below, these templates are used together to provide accurate and repeatable angular positioning of miter gauge 710.

Miter gauge 710 includes a positioning plate actuator 740 pivotably connected to base plate 713. Positioning plate actuator 740 includes an actuator tooth 742 for engaging teeth 720 of positioning plate 712 when actuator 740 is pivoted to a position where actuator tooth 742 is located in a notch on positioning edge 718 formed by two adjacent teeth 720. When actuator tooth 742 is so engaged, a thumbscrew (not shown) whose threaded shaft is disposed through a gap 744 on actuator 740 and threaded into a threaded hole in base plate 713 is tightened, clamping the actuator between the head of the thumbscrew and base plate 713. With the actuator locked in place, angular movement of positioning plate 712 relative to base plate 713 is inhibited by the engagement of actuator tooth 742 and teeth 720 of positioning plate 712. However, the interfaced plates 712 and 713 may still be pivoted as a unit relative to guide 716 about shoulder bolt 714 when thumbscrew 728 is not tightened.

In this embodiment, course adjustment of angular position is achieved by pivoting positioning plate 712 relative to base plate 713 and inhibiting relative movement between those plates by engaging actuator 740 with teeth 720 at an angular position close to the desired final angular position. Preferably, teeth 720 on positioning edge 718 are positioned to provide notches for engaging actuator 740 at five-degree angles relative to shoulder bolt 714.

Fine adjustment of angular position is achieved by pivoting the combined plates 712 and 713 relative to guide 716. A fine adjustment actuator 746 is pivotably connected to guide 716 using a bolt 747. Fine adjustment actuator 746 includes a first engagement tooth 748 and a second engagement tooth 750 disposed on opposite sides of the longitudinal axis of guide 716. When fine adjustment actuator 746 is pivoted clockwise about bolt 747, first engagement tooth 748 may engage teeth 734 of base plate 713. When fine adjustment actuator 746 is pivoted counter-clockwise about bolt 747, second engagement tooth 750 may engage teeth 732.

Preferably, the teeth 734 engaged by first engagement tooth 748 are spaced to provide notches for engaging fine adjustment actuator 746 according to whole-number angular positions of base plate 713 relative to guide 716 (e.g., 0, ±1, ±2, ±3, etc. degrees). Also, the teeth 732 engaged by second engagement tooth 750 are preferably spaced to provide notches for engaging fine adjustment actuator 746 according to half-degree angular positions of base plate 713 relative to guide 716 (e.g., ±½, ±1½, ±2½, etc. degrees).

The operation of this embodiment can be illustrated by the following example. If the operator desires to set the miter gauge at an angle of 37½ degrees, the operator first loosens thumbscrew 728 and disengages actuator 740 by loosening the thumbscrew that secures that actuator. Positioning plate 712 is then rotated clockwise relative to base plate 713 to the angular position where actuator tooth 742 can be inserted into the notch formed by adjacent teeth 720, which notch corresponds to 35 degrees on template 736. After actuator 740 has been pivoted to insert actuator tooth 742 into the appropriate 35-degree notch, the operator tightens the thumbscrew (not shown) disposed through gap 744 to lock actuator 740 in place. This completes the course-adjustment part of the operation. Then, the combined plates 712 and 713 are pivoted clockwise together about shoulder bolt 714 to the angular position where second engagement tooth 750 can be inserted into the notch formed by adjacent teeth 734 on base plate 713, which notch corresponds to 2½ degrees on template 738. After fine adjustment actuator 746 has been pivoted counterclockwise to insert second engagement tooth 750, the operator tightens thumbscrew 752 which is disposed through gap 754 in fine adjustment actuator 746 and threaded into guide 716 to inhibit angular movement of base plate 713 relative to guide 716. Also, the operator then tightens thumbscrew 728 to further inhibit any angular rotation. Thus, the 37½ degree desired angle is achieved by the combination of the 35 degree course-adjustment rotation and the 2½ degree fine-adjustment rotation.

Of course, those of ordinary skill in the art will appreciate that miter gauge 710 can be set at any angular position between −90 and +90 degrees, not just one-half degree increments. When the desired angular position does not correspond to a half-degree increment, the operator engages actuator 740 with teeth 720 at an angle close to the desired angle. Then, the operator uses the fine-adjustment part of miter gauge 710 to complete the angular positioning. For example, if an angular setting of 42.2 degrees were required, positioning plate 712 would be rotated clockwise and actuator 740 locked in place with actuator tooth 742 inserted in the notch on positioning plate 712 corresponding to 40 degrees. Then, the combined plates 712 and 713 would be rotated clockwise about shoulder bolt 714 until the tip of first engagement tooth 748 pointed to an angular position 2/10 of a degree between the 2-degree and 3-degree marks on template 738 when the tip of first engagement tooth 748 is positioned against positioning edge 735. Miter gauge 710 is then locked in position by tightening thumbscrew 728.

It will also be understood by those skilled in the art that the embodiments set forth hereinbefore are merely exemplary of the numerous arrangements for which the invention may be practiced, and as such may be replaced by equivalents without departing from the invention which will now be defined by appended claims.

What is claimed is:

1. A miter gauge comprising:

a guide adapted for disposition on a working surface of a woodworking tool;

a base pivotably connected to the guide;

a positioning plate pivotably connected to the base;

a first positioning edge disposed on the positioning plate, the first positioning edge having a first plurality of teeth;

a positioning plate actuator pivotably connected to the base and configured to engage at least one of the first plurality of teeth;

a second positioning edge disposed on the base, the second positioning edge having a second plurality of teeth;

a fine adjustment actuator pivotably connected to the guide and configured to engage at least one of the second plurality of teeth; and a fastener threadingly engaged with the guide and configured to selectively prevent movement of the base and the positioning plate relative to the guide.

2. A miter gauge according to claim 1, wherein the fastener is a thumbscrew.

3. A miter gauge according to claim 1 further comprising:

a first plurality of notches formed by the first plurality of teeth;

a second plurality of notches formed by the second plurality of teeth;

wherein the first plurality of notches are angularly spaced at 5 degree intervals; and wherein the second plurality of notches are angularly spaced such to allow ½ degree angular adjustment of the base relative to the guide.

4. A miter gauge according to claim 1 further comprising:

a second plurality of notches formed by the second plurality of teeth; and wherein the fine adjustment actuator includes a first engagement tooth and a second engagement tooth, each engagement tooth configured to engage different portions of the second plurality of notches.

5. A miter gauge according to claim 1 further comprising:

a first plurality of notches formed by the first plurality of teeth;

a second plurality of notches formed by the second plurality of teeth;

wherein the first plurality of notches are angularly spaced at 5 degree intervals;

wherein the fine adjustment actuator includes a first engagement tooth and a second engagement tooth;

wherein the first engagement tooth is configured to engage one portion of the second plurality of notches to provide adjustment of the base relative to the guide according to whole-number angular positions; and wherein the second engagement tooth is configured to engage another portion of the second plurality of notches to provide adjustment of the base relative to the guide according to half-degree angular positions.

6. A miter gauge according to claim 5, wherein the first engagement tooth and the second engagement tooth are disposed on opposite sides of a longitudinal axis of the guide.

7. A miter gauge according to claim 6, wherein the fastener is capable of being tightened when the first engagement tooth and the second engagement tooth are not engaged with any of the second plurality of notches, thereby providing angular adjustment of the base relative to the guide between the whole-number angular positions and the half-degree angular positions.

8. A miter gauge according to claim 1 further comprising a flange connected to the positioning plate, the flange adapted for attachment to a fence.

9. A miter gauge according to claim 1 further comprising:

a first template disposed on the positioning plate, the first template including markings according to angular positioning of the positioning plate relative to the base, a second template disposed on the base, the second template including markings according to angular positioning of the base relative to the guide.

10. A miter gauge comprising:

a guide adapted for disposition on a working surface of a woodworking tool;

a base adjustably connected to the guide, wherein the base includes a second positioning edge having a second plurality of teeth;

a positioning body adjustably connected to the base, wherein the positioning body includes a first positioning edge having a first plurality of teeth;

a positioning body actuator adjustably connected to the base and configured to engage at least one of the first plurality of teeth;

a secondary adjustment actuator adjustably connected to the guide and configured to engage at least one of the second plurality of teeth;

a first plurality of notches formed by the first plurality of teeth;

a second plurality of notches formed by the second plurality of teeth;

wherein the first plurality of notches are angularly spaced at 5 degree intervals;

wherein the secondary adjustment actuator includes a first engagement tooth and a second engagement tooth;

wherein the first engagement tooth is configured to engage one portion of the second plurality of notches to provide adjustment of the base relative to the guide according to whole-number angular positions;

wherein the second engagement tooth is configured to engage another portion of the second plurality of notches to provide adjustment of the base relative to the guide according to half-degree angular positions;

wherein the secondary adjustment actuator is pivotably connected to the guide; and wherein the first engagement tooth and the second engagement tooth are disposed on opposite sides of a longitudinal axis of the guide.

11. A miter gauge comprising:

a guide adapted for disposition on a working surface of a woodworking tool;

a base;

a first connection means for pivotably connecting the base to the guide;

a positioning body connected to the base, wherein the positioning body includes a first positioning edge having a first plurality of teeth disposed on the first positioning edge;

means for inhibiting movement of the positioning body relative to the base;

a second positioning edge disposed on the base, the second positioning edge having a second plurality of teeth disposed on the second positioning edge;

a fine adjustment actuator adjustably connected to the guide and configured to engage at least one of the second plurality of teeth such that movement of the base is inhibited relative to the guide;

a second connection means for limiting rotation of the base and the positioning body relative to the guide; and wherein the second connection means is a fastener passing through an arcuate slot in the positioning body and an aperture in the base, the fastener further being received by a threaded hole in the guide.

12. A miter gauge comprising:

a guide adapted for disposition on a working surface of a woodworking tool;

a base;

a first connection means for pivotably connecting the base to the guide;

a positioning body connected to the base, wherein the positioning body includes a first positioning edge having a first plurality of teeth disposed on the first positioning edge;

means for inhibiting movement of the positioning body relative to the base;

a second positioning edge disposed on the base, the second positioning edge having a second plurality of teeth disposed on the second positioning edge;

a fine adjustment actuator adjustably connected to the guide and configured to engage at least one of the second plurality of teeth such that movement of the base is inhibited relative to the guide; and wherein the means for inhibiting movement of the positioning body is a positioning body actuator adjustably connected to the base and configured to engage at least one of the first plurality of teeth.

13. A miter gauge comprising:

a guide adapted for disposition on a working surface of a woodworking tool;

a base;

a first connection means for pivotably connecting the base to the guide;

a positioning body connected to the base, wherein the positioning body includes a first positioning edge having a first plurality of teeth disposed on the first positioning edge;

means for inhibiting movement of the positioning body relative to the base;

a second positioning edge disposed on the base, the second positioning edge having a second plurality of teeth disposed on the second positioning edge;

a fine adjustment actuator adjustably connected to the guide and configured to engage at least one of the second plurality of teeth such that movement of the base is inhibited relative to the guide;

a first plurality of notches formed by the first plurality of teeth;

a second plurality of notches formed by the second plurality of teeth;

wherein the first plurality of notches are angularly spaced at 5 degree intervals;

wherein the fine adjustment actuator includes a first engagement tooth and a second engagement tooth;

wherein the first engagement tooth is configured to engage one portion of the second plurality of notches to provide adjustment of the base relative to the guide according to whole-number angular positions;

wherein the second engagement tooth is configured to engage another portion of the second plurality of notches to provide adjustment of the base relative to the guide according to half-degree angular positions;

wherein the fine adjustment actuator is pivotably connected to the guide; and wherein the first engagement tooth and the second engagement tooth are disposed on opposite sides of a longitudinal axis of the guide.

* * * * *